US006877520B2

(12) United States Patent
Morris

(10) Patent No.: US 6,877,520 B2
(45) Date of Patent: Apr. 12, 2005

(54) CANE BASE

(76) Inventor: James K. Morris, 1054 Monterey La., Fircrest, WA (US) 98466

( * ) Notice: Subject to any disclaimer, the term of this patent is extended or adjusted under 35 U.S.C. 154(b) by 0 days.

(21) Appl. No.: 10/313,107

(22) Filed: Dec. 4, 2002

(65) Prior Publication Data

US 2004/0107982 A1 Jun. 10, 2004

(51) Int. Cl.[7] ..... A45B 9/04; A61H 3/02
(52) U.S. Cl. ..... 135/77; 135/85; 135/86
(58) Field of Search ..... 135/65, 77, 82, 135/86, 78; 36/26, 28

(56) References Cited

U.S. PATENT DOCUMENTS

| | | | | | |
|---|---|---|---|---|---|
| 81,900 | A | | 9/1868 | Harrison | |
| 960,700 | A | | 6/1910 | Pratt | |
| 1,305,867 | A | * | 6/1919 | Atlas | 135/78 |
| 1,438,883 | A | | 12/1922 | Youngren | |
| 2,301,385 | A | * | 11/1942 | Ehrgott | 248/346.11 |
| 2,429,409 | A | * | 10/1947 | Eidman | 135/72 |
| 2,642,074 | A | * | 6/1953 | Pedley et al. | 135/65 |
| 3,199,886 | A | * | 8/1965 | Kent | 280/824 |
| 4,510,957 | A | | 4/1985 | Frank | 135/84 |
| 4,601,302 | A | * | 7/1986 | Breen et al. | 135/66 |
| 4,708,154 | A | * | 11/1987 | Edwards | 135/84 |
| 4,881,564 | A | * | 11/1989 | Fetterman | 135/82 |
| 4,899,771 | A | * | 2/1990 | Wilkinson | 135/77 |
| 4,947,882 | A | | 8/1990 | Levasseur | 135/84 |
| 5,307,828 | A | * | 5/1994 | Gardner et al. | 135/82 |
| 5,353,825 | A | | 10/1994 | Davis | 135/78 |
| 5,896,680 | A | * | 4/1999 | Kim et al. | 36/28 |
| 6,098,313 | A | * | 8/2000 | Skaja | 36/28 |
| 6,131,593 | A | * | 10/2000 | Greene et al. | 135/77 |
| 6,138,699 | A | * | 10/2000 | Su | 135/82 |
| 2003/0226585 | A1 | * | 12/2003 | Burchel | 135/77 |

* cited by examiner

*Primary Examiner*—Anita King
*Assistant Examiner*—Amy J. Sterling
(74) *Attorney, Agent, or Firm*—Seed IP Law Group PLLC

(57) ABSTRACT

A cane having a base formed from a cup-shaped support having a concave bottom surface and a top surface defined by a circumscribing exterior sidewall having a bottom edge. The concave bottom surface is formed to have a plurality of resilient projections extending therefrom a distance to project slightly beyond the bottom edge of the sidewall. The projections are formed in a spoke-like pattern on the bottom surface such that the density of the projections is greater near the central section of the bottom surface than at the periphery of the bottom surface. The projections are also formed to have a length that varies according to their position on the bottom surface so that a substantially planar contacting edge is presented to a support surface.

12 Claims, 3 Drawing Sheets

CANE BASE

BACKGROUND OF THE INVENTION

1. Field of the Invention

The present invention is directed to walking supports, such as crutches, canes, and the like, and more particularly to a base for canes and crutches, the base having improved surface gripping characteristics.

2. Description of the Related Art

Numerous designs exist for crutches, canes, and walking sticks to provide comfort while supporting a user on a variety of surfaces. Examples of such designs include the following issued patents:

U.S. Pat. No. 960,700 issued to Pratt teaches a crutch tip that includes apexes and depressions to provide a surface that is less prone to slipping. However, in Pratt the surface is taught as being convex, which may actually enhance slipping on certain surfaces.

U.S. Pat. No. 1,438,883 issued to Youngren discloses a crutch tip that includes an inflatable bulb having a roughened surface 13. This reference also teaches a convex surface that in this case can be adjusted by the amount of inflation.

U.S. Pat. No. 4,510,957 issued to Frank discloses resilient supports for walking aids, particularly crutches, that has a monoblock with truncated pyramids 82 depending therefrom. Frank does not teach or suggest a concave-shaped foot with projections of varying diameter and length.

U.S. Pat. No. 4,947,882 issued to Levasseur discloses crutches, walking sticks, and the like having a tip that includes cylinders 4 of flexible material. However, Levasseur does not teach or suggest the tip having a concave bottom surface with a plurality of extensions depending therefrom in a spoke-like pattern.

U.S. Pat. No. 5,307,828 issued to Gardner et al. discloses a support foot assembly for a cane or crutch that, as shown in FIGS. 2 and 3, includes an array of rubber fingers 32 that are intermittently coated with neoprene. These bristles extend far below the supporting surface and because of their length and material will easily flex, resulting in instability.

U.S. Pat. No. 5,353,825 issued to Davis illustrates a radial crutch tip that includes a bottom boot. A variety of bottom boot patterns is disclosed with FIG. 5 showing a plurality of hollowed-out cavities. Davis does not show a plurality of fingers or protrusions extending from a boot with varying diameters and lengths for any pattern thereof.

BRIEF SUMMARY OF THE INVENTION

The present invention is directed to a base for a cane that includes a cup-shaped support having a concave bottom surface and a top surface defined by a circumscribing exterior sidewall having a bottom edge. The concave bottom surface includes a plurality of resilient projections extending therefrom a distance to project beyond the bottom edge. The projections are formed in a pattern on the bottom surface to be more dense in a central section of the bottom surface of the support.

In accordance with another aspect of the foregoing embodiment, the projections each have a circular cross-sectional configuration, with the projections nearer the central section of the support having thicker diameters than the diameters of the remaining projections. Ideally the projections are arranged in a spoke-like pattern on the bottom surface, each spoke having projections nearer the center of the support with a diameter that is thicker than the diameter of the projections near the sidewall.

In accordance with another embodiment of the invention, a base for a cane is provided that has a support having a concave bottom surface, a top surface, and an exterior sidewall having a bottom edge adjacent the bottom surface; a receiving member on the top surface configure to receive the cane; a plurality of gussets formed on the top surface of the support and connected to the receiving member; and a plurality of projections formed on the bottom surface of the support and having a length to extend beyond the bottom edge of the sidewall, the projections formed to have a higher density of projections in a central section of the bottom surface than at a peripheral portion adjacent the bottom edge of the sidewall.

In accordance with a further embodiment of the invention, a cane is provided that includes a support post having first and second ends; a handle mounted on the first end; and a base mounted on the second end, the base including a support having a concave bottom surface, a top surface, and an exterior sidewall having a bottom edge adjacent the bottom surface; a receiving member on the top surface configure to receive the cane; a plurality of gussets formed on the top surface of the support and connected to the receiving member; and a plurality of projections formed on the bottom surface of the support and having a length to extend beyond the bottom edge of the sidewall, the projections formed to have a higher density of projections in a central section of the bottom surface than at a peripheral portion adjacent the bottom edge of the sidewall.

BRIEF DESCRIPTION OF THE SEVERAL VIEWS OF THE DRAWING(S)

The features and advantages of the disclosed embodiments of the invention will be more readily understood from the following detailed description when taken in conjunction with the following drawings, wherein.

DETAILED DESCRIPTION OF THE INVENTION

Figure 1:
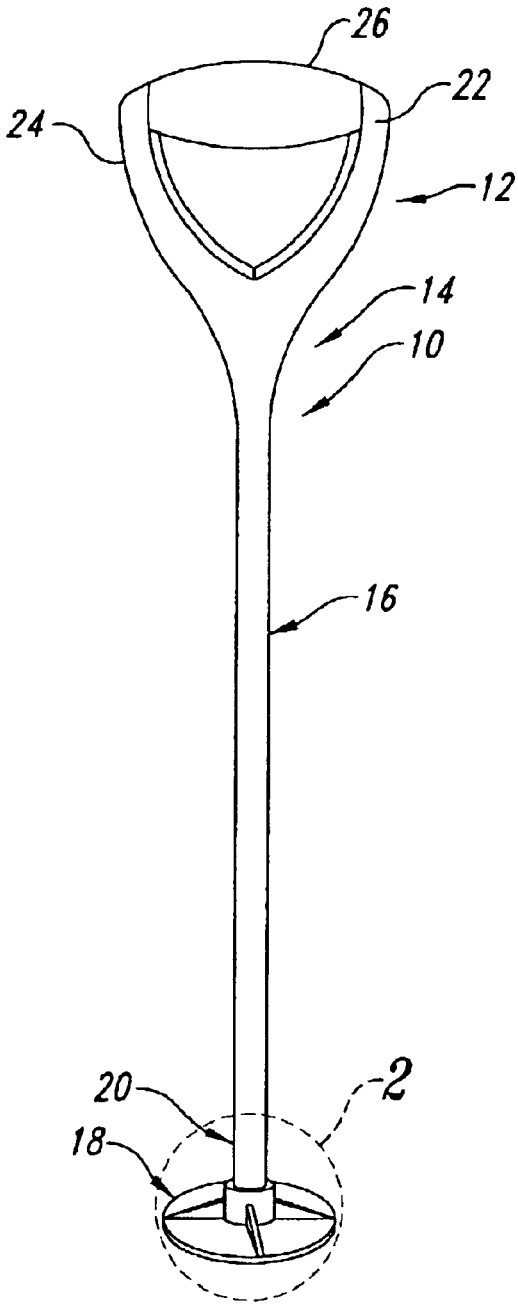
FIG. 1 is an isometric projection of a cane with a base formed in accordance with the present invention.

Referring initial to FIG. 1, shown therein is a cane 10 having a handle 12 formed at a first end 14 of a support shaft 16 and a base 18 formed at a second end 20 thereof. The handle 12 has a Y-shaped configuration formed of a first branch 22 and a second branch 24 that are connected together by a handgrip 26. The Y-shaped configuration of the handle 12 ensures that the weight of a user is concentrated on the shaft 16 regardless of where the user grips the handle 12.

It is to be understood that while the invention is described in the context of a cane, its principles can be applied to other devices used to aid in walking and supporting people, including crutches, walking sticks, and the like.

Figure 2:
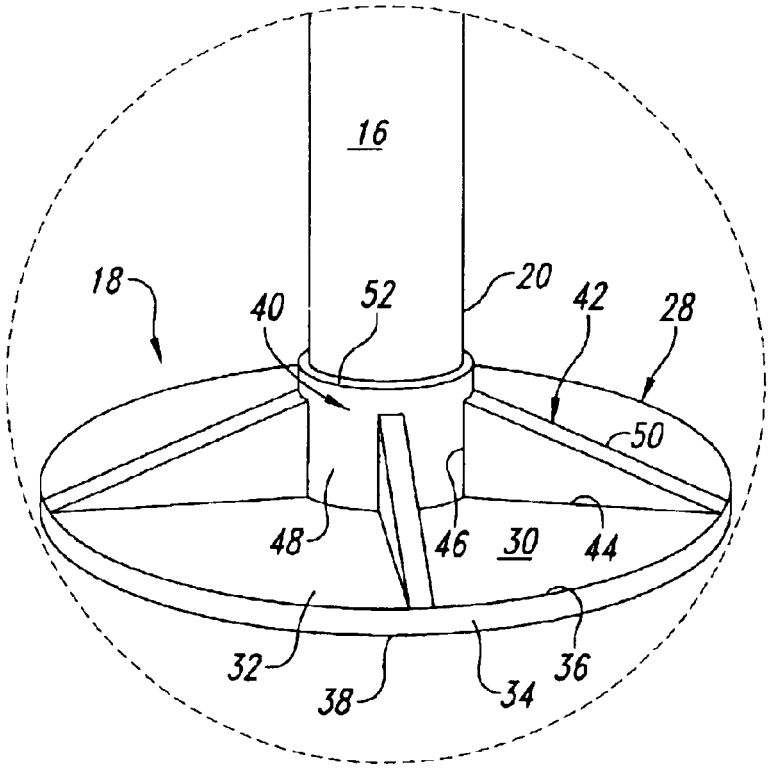
FIG. 2 is an enlarged isometric projection of the base of FIG. 1.

Referring to FIG. 2, an enlarged view of the second end 20 of the shaft 16 is shown having the base 18 mounted thereon. The base comprises a substantially circular support 28 having a top surface 30, a bottom surface 32, and a sidewall 34 with a top edge 36 adjacent the top surface 30 and a bottom edge 38 adjacent the bottom surface 32.

Formed on the top surface 30 of the support 28 is a cylindrical mounting cup 40 that is preferably integrally formed with the support 28. The mounting cup 40 is centrally located on the support 28 and is sized and shaped to slidably receive the second end 20 of the cane shaft 16. The cane shaft 16 is retained in engagement with the mounting cup 40 by conventional means, which can include one or more of the following, an interference fit, adhesive, fasteners, and so forth.

Also shown on the top surface 30 of the support 28 are a plurality of gussets 42 to reinforce the support and to reinforce the attachment of the mounting cup 40 to the support 28. Each gusset 42 has a bottom side 44 that extends from the mounting cup 40 to the sidewall 34. An upright side 46 extends orthogonal to the bottom side 44 and is attached to, or more preferably integrally formed with, the sidewall 48 of the mounting cup 40. A top side 50 angles down from the upright side 46 to the bottom side 44, ending at the top edge 36 of the sidewall 34. In the embodiment shown in FIG. 2, the upright side 46 of the gusset 42 does not extend to the top side 52 of the mounting cup 40. This provides some flexibility in the annular portion adjacent the top side 52 of the sidewall 48 when the cane shaft 16 is slid into the mounting cup 40. The gussets 42 are preferably integrally formed with the support 28 and mounting cup 40, although they may be manufactured separately and attached in a conventional manner.

Ideally, at least four gussets 42 are spaced equidistantly about the support 28 and have a thickness such that they will not readily collapse when placed under pressure, such as when the cane 10 contacts a surface 54 at an angle, although some resiliency is necessary to ensure adequate friction and contact with the surface 54.

Figure 3:
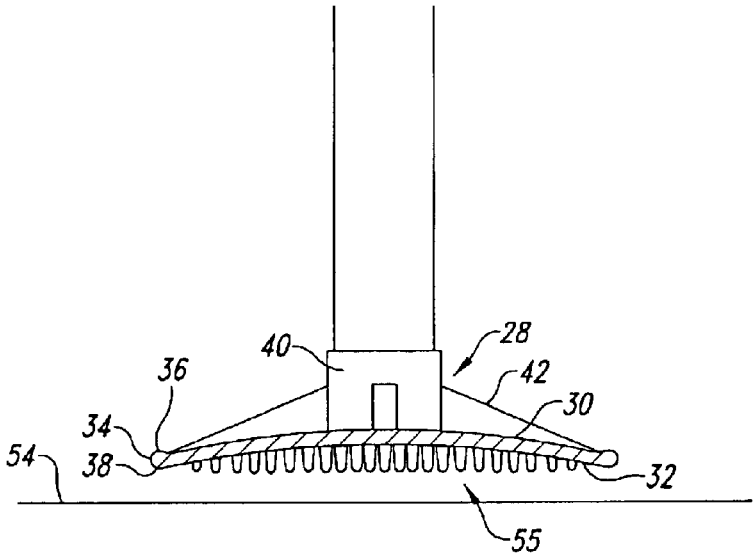
FIG. 3 is a partial cross-sectional side view of the base of FIG. 2.

Referring next to FIG. 3, a partial cross-sectional view of the support 28 is shown. A plurality of projections 55 are formed on the bottom surface 32 to extend therefrom a predetermined distance. Ideally, the projections 55 extend below the bottom edge 38 of the support 28 a distance in the range of 0 to 0.25 inches, and preferably at a distance of 1/32nd inch. The projections 55 preferably are formed of substantially rigid material that is slightly compliant such that the bottom edge 38 of the support 28 will contact the surface 54 when weight is exerted on the projections 55. In this way, the projections 55 provide more surface contact while preventing the edge 38 from creating a suction seal against the surface 54, which is possible with the cup-shaped bottom surface 32. Thus, the bottom edge 38 provides stability and enhances the gripping ability of the base 18.

Figure 4:
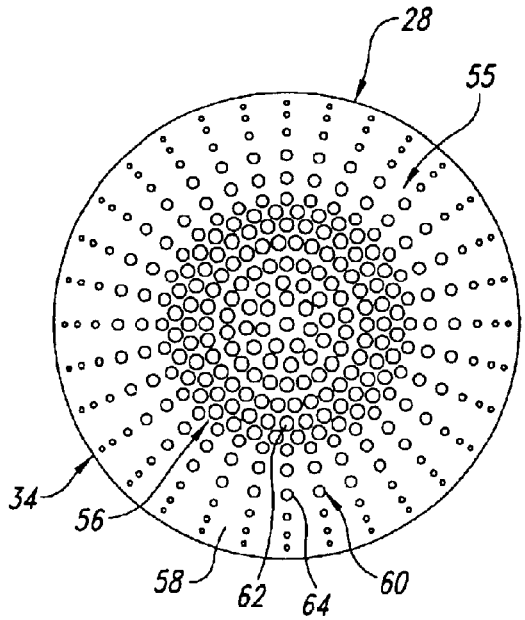
FIG. 4 is a bottom view of the base formed in accordance with one embodiment of the present invention.

FIG. 4 shows the bottom surface 32 of the support 28 to include a substantially circular central area 56 having a radius that is about ½ the radius of the support 28. The ring-shaped periphery 58 extends from the central section 56 to the sidewall 34.

As can be seen from FIG. 4, the projections 55 are preferably arranged in a pattern of spokes 60 extending outward from the central section 56 to the sidewall 34. Each spoke 60 includes a plurality of projections 55 with the projections 62 in the central section 56 having a larger diameter than the diameter of the projections 64 arranged in the periphery section 58. In the preferred embodiment, each projection 55 has a substantially circular cross-sectional configuration, with the projections 62 in the central section 56 having a diameter that is larger than the diameter of the projections 64 in the periphery section 58. In addition, as a can be seen from the cross-sectional view of FIG. 3, the projections 64 in the periphery area have a shorter length than that of the projections 62 in the central section 56 to ensure that all projections 55 present a substantially planar bearing surface as a whole when applied to the support surface 54.

Preferably, each of the projections 55 is integrally formed with the support 28. The material of the support 28 and the projections is selected from a substance that provides a high coefficient of friction on wet or dry surfaces. Such compositions include rubber, polypropylene, neoprene or similar materials or a combination of the foregoing as will be known to those skilled in the art.

Ideally, the projections 55 have a diameter in the range of ⅛ inch to ¼ inch. The thickness of the support 28 is preferably ⅜ inches, although it may be in the range of ¼ inch to 7/16 inch. While a circular configuration is shown for the support 28, a polygonal configuration may be used, with no less than six sides because of the efficiency of using a circular shape with respect to surface contact area.

While a preferred embodiment of the invention has been illustrated and described, it is to be understood that various changes may be made therein without departing from the spirit and scope of the invention. Thus, the height of the mounting cup 40 may be altered, so long as the height of the gussets 42 is appropriately altered to maintain the rigid support of the base 18. Various other dimensional changes may also be made without departing from the spirit and scope of the invention, so long as the size of the support 28 in terms of its diameter remains substantially in the range of 3 to 3½ inches. Thus, the invention is not to be limited by the foregoing description but only by the scope of the claims that follow and the equivalents thereof.

What is claimed is:

1. A base for supporting a cane on a supporting surface, comprising:

a support post having a first and second end, a handle formed on the first end of the support post, a support having a concave bottom surface, a top surface, and an exterior sidewall having a bottom edge adjacent the bottom surface;

a receiving member on the top surface configured to receive the cane;

a plurality of gussets formed on the top surface of the support and connected to the receiving member; and a plurality of resilient projections formed on the bottom surface of the support and having a length to extend beyond the bottom edge of the sidewall which prevents the bottom edge from forming a suction seal against the supporting surface, the projections formed to have a higher density of projections in a central section of the bottom surface than at a peripheral portion adjacent to the bottom edge of the sidewall.

2. The base of claim 1 wherein the projections have a circular cross-sectional configuration.

3. The base of claim 2 wherein the projections near the central section of the support have a thicker diameter than a diameter of the remaining projections.

4. The base of claim 1 wherein the projections are formed in a pattern of radially-projecting spokes on the bottom surface of the support.

5. The base of claim 4 wherein each spoke of projections comprises projections near the center of the support having a diameter that is greater than a diameter of projections near the sidewall.

6. The base of claim 1 wherein the support has a diameter in the range of 3 inches to 3½ inches.

7. A cane for use on a supporting surface, comprising:

a support post having first and second ends;

a handle mounted on the first end of the support post; and a base mounted on the second end of the support post, the base comprising:

a support having a concave bottom surface, a top surface, and an exterior sidewall having a bottom edge adjacent the bottom surface;

a receiving member on the top surface configured to receive the cane;

a plurality of gussets formed on the top surface of the support and connected to the receiving member; and a plurality of resilient projections formed on the bottom surface of the support and having a length to extend beyond the bottom edge of the sidewall which prevents the bottom edge from sealing against the supporting surface, the projections formed to have a higher density of projections in a central section of the bottom surface than at a peripheral portion adjacent to the bottom edge of the sidewall.

8. The base of claim 7 wherein the projections have a circular cross-sectional configuration.

9. The base of claim 8 wherein the projections near the central section of the support have a thicker diameter than a diameter of the remaining projections.

10. The base of claim 7 wherein the projections are formed in a pattern of radial spokes on the bottom surface of the support.

11. The base of claim 10 wherein each radial spoke of projections comprises projections near the center of the support having a diameter that is greater than a diameter of projections near the sidewall.

12. The base of claim 7 wherein the support has a diameter in the range of 3 inches to 3½ inches.

* * * * *